US007297396B2

(12) United States Patent
Wang et al.

(10) Patent No.: US 7,297,396 B2
(45) Date of Patent: Nov. 20, 2007

(54) GYPSUM BOARDS HAVING GLASS FIBER REINFORCEMENT WITH TACKY COMPLIANT INTERFACE THEREBETWEEN

(75) Inventors: Lance Wang, Parker, CO (US); Thomas G. Grassl, Gross-Gerau (DE); Robert David Hamilton, Littleton, CO (US)

(73) Assignee: Johns Manville, Denver, CO (US)

( * ) Notice: Subject to any disclaimer, the term of this patent is extended or adjusted under 35 U.S.C. 154(b) by 470 days.

(21) Appl. No.: 10/910,183

(22) Filed: Aug. 3, 2004

(65) Prior Publication Data

US 2006/0029786 A1 Feb. 9, 2006

(51) Int. Cl.
*B32B 29/02* (2006.01)
*D04H 1/00* (2006.01)

(52) U.S. Cl. ..... 428/292.7; 428/294.7; 428/292.1

(58) Field of Classification Search ..... 428/292.7, 428/312.4, 22 D, 537.5; 524/253, 837, 156, 524/606

See application file for complete search history.

(56) References Cited

U.S. PATENT DOCUMENTS 4,645,548 A * 2/1987 Take et al. ..... 156/39
2003/0134079 A1* 7/2003 Bush et al. ..... 428/74

* cited by examiner

*Primary Examiner*—Jill Gray
(74) *Attorney, Agent, or Firm*—Robert D. Touslee

(57) ABSTRACT

A bond is created during gypsum board cure between a gypsum matrix and a tacky coating applied onto a glass fiber. The tacky coating is comprised of a polymer composed of methacrylic acid and dimethyldiallyammonium chloride. The polymer is dissolved in an acidic aqueous solution and is roller coated onto the glass fibers. The chopped glass fibers may also be placed in such an acidic solution, which is made alkaline by the addition of alkali, thereby precipitating the polymer out of solution as a tacky composition that produces a tacky coating on the glass fibers. The glass fibers with the tacky bond coating are incorporated in an alkaline gypsum slurry to form a gypsum board having a first and second facer sheet. The tacky coating on the glass fibers bonded to the gypsum matrix result in compliant load transfer between the gypsum matrix and the glass fibers, yielding improved flexure strength and nail pullout resistance.

14 Claims, 2 Drawing Sheets

GYPSUM BOARDS HAVING GLASS FIBER REINFORCEMENT WITH TACKY COMPLIANT INTERFACE THEREBETWEEN

BACKGROUND OF THE INVENTION

1. Field of the Invention

The present invention relates to an improved gypsum board for use in building construction and to a process for its manufacture; and more particularly, to a gypsum board having a gypsum matrix with glass fibers having a tacky bond layer thereby providing superior gypsum board flexure strength and nail pullout resistance.

2. Description of the Prior Art

Gypsum wallboard and gypsum panels are traditionally manufactured by a continuous process. The conventional process for manufacturing gypsum wallboard includes premixing of dry ingredients of the core composition, which can include calcium sulphate hemihydrate ($CaSO_4.½H_2O$, also known as calcined gypsum, stucco, and plaster of Paris), accelerator, starch, glass fiber and others. The premix of dry ingredients is then mixed with "wet" portion of the core composition in a pin mixer. The "wet" portion can include water, foaming agent, paper pulp, fluidity-increasing agent, and other conventional additives. Various additives, e.g. cellulose and glass fibers, are often added to the slurry to strengthen the gypsum core. Starch is frequently added to the slurry in order to improve the adhesion between the gypsum core and the facing.

The resulting gypsum slurry is continuously deposited to form a gypsum wallboard core between two continuously supplied moving sheets of cover paper. The two cover sheets are typically a pre-folded face paper and a backing paper. As the gypsum slurry is deposited onto the face paper, the backing paper is laid over the gypsum slurry and bonded to the pre-folded edges of the face paper with a suitable adhesive. The enclosed gypsum core slurry is then sized for thickness through forming plates or roller bars and allowed to set between two cover sheets, thereby forming a board. The setting process is a rehydration reaction that transforms calcium sulfate hemihydrate to calcium sulfate dihydrate, shown as follows.

$$CaSO_4.½H_2O+1½H_2O \rightarrow CaSO_4.2H_2O+\text{Heat}$$

Once the gypsum core has set sufficiently, the continuously produced board is cut into desired lengths and vertically stacked. After the cutting and stacking step, the gypsum boards are fed into drying ovens or kilns to evaporate the excess water. Inside the drying ovens, the boards are blown with hot drying air. After the dried gypsum boards are removed from the ovens, the ends of the boards are trimmed off and the boards are cut to desired sizes. The boards are commonly sold to the building industry in the form of sheets. These sheets are usually 4 feet wide, 8 to 12 feet long and 0.5 to 1 inches thick, the width and length dimensions defining the two faces of the board.

Wallboard formed of a gypsum core sandwiched between facing layers is used in the construction of virtually every modern building. In its various forms, the gypsum board is used as an interior or exterior surface for walls, ceilings and the like. The gypsum board is relatively easy and inexpensive to install, finish, and maintain, and depending on the composition of the gypsum matrix, may be relatively fire resistant. A number of patents discuss various reinforcement fibers with polymeric coatings within gypsum and other hydrated matrices.

U.S. Pat. No. 4,241,136 to Dereser et al. (hereinafter the '136 patent) discloses a process and composition for treating glass fibers for use in reinforcement of cementitious materials. The fibers are first sized with a cationic fiber forming organic polymer and then with a second coating containing an anionic film-forming organic polymer. The resulting fibers are said to have good wetting and dispersibility characteristics. The '136 patent suggests that the high surface charge density of asbestos fibers, in combination with a high specific surface area, permit them to flocculate cement mixed therewith, thereby providing a substantial degree of reinforcement to structural articles. However, replacement of asbestos fibers with glass is said not to have the expected benefit, in that the glass fibers tend to adhere together and thereby inhibit the removal of water during mat or board production. In addition, the much lower specific surface area of glass fibers results in poor retention of either cement or water thereon, in comparison with asbestos. The glass fibers do not have similar surface charges and the '136 patent sizing process is ineffective in bonding exclusively glass fibers without asbestos. Furthermore, the sizing utilized in the '136 patent is not a polymeric coating which is tacky.

U.S. Pat. No. 4,935,301 to Rerup et al. relates to a cement composite containing glass fibers encapsulated with a polymeric coating which is formed from an organic solution of an interpolymer complex of an anionic polymer and a cationic polymer. The fiber reinforcement is said to impart to the composite improved high apparent toughness, ductility, and flexural and tensile strengths, along with improved resistance to embrittlement and strength loss with age. The fibers are disposed in bundles, which are encapsulated with an elastomeric material. The encapsulant wraps the bundles of fibers but does not coat the individual fibers, nor does the coating impregnate the bundle or fill the voids between the individual fibers. The fibers are disposed in any cementitious matrix, including Portland cement, concrete, mortar, gypsum, and hydrous calcium silicate. The elastomeric coating is applied in an organic solvent and is not applied in a water-based system. The composite formed is primarily a cement composite, even though gypsum composite is casually mentioned in the patent. The anionic and cationic polymers are related to bond creation with the fiber prior to incorporation in the matrix and do not result in a tacky bond.

U.S. Pat. No. 5,100,474 to Hawkins (hereinafter the '474 patent) discloses a glass fiber reinforced composition of a settable mix of plaster, a water-based phenol formaldehyde resin, an acid hardener, and reinforcing glass fibers. The invention is said to advantageously have a lower resin content compared to glass fiber plastic products produced by known laying up techniques resulting from the incorporation of plaster. The '474 patent further discloses three methods of producing flat sheet and molded form products: (i) premixing of the constituents, followed by pouring or injection into open or closed molds; (ii) hand lamination; and (iii) hand spray lamination. The formaldehyde resin does not form a tacky bond layer between the plaster matrix and glass fiber.

U.S. Pat. No. 5,786,080 to Andersen et al. discloses compositions and methods for the deposition of ettringite ($3CaO—Al_2O_3.3Ca(SO_4).30\text{-}32H_2O$) onto the surfaces of fibers, aggregates, or other fillers. The ettringite is produced in situ within an aqueous suspension while in proximity of the fibers, aggregates, or fillers, to form a mineralized composite material comprising ettringite coated fibers, aggregates or other fillers. The ettringite-coated materials can be added to hydraulically settable materials to improve the chemical and mechanical bond between the fibers or other substrate within the resulting hardened hydraulically settable materials, particularly cementitious or concrete material. The presence of the coated fiber materials is said generally to increase the toughness, flexibility, tensile strength, and flexural strength of the composite and articles made therefrom. It is indicated that the ability of fibers to modify the mechanical properties of a composite is dependent on the strength of the bonding between the fibers and the matrix material. The ettringite process is said to increase the roughness of the coated fibers, thereby enhancing the mechanical interlocking with the matrix over that achieved with relatively smooth glass fibers. The ettringite composition is an inorganic coating and not a tacky polymeric coating.

U.S. Pat. No. 5,879,825 to Burke et al. discloses a gypsum wallboard and method of making same. The board is made with a core of calcium sulfate hemihydrate (stucco), water, and a strengthening agent from a slurry. The slurry contains paper pulp fiber reinforcement. The strengthening agent is an acrylic polymer composition having a glass transition temperature of about 15° C. or greater, and preferably has good divalent ion stability so that it is suitable in a medium of calcium ions. The method provides wallboard having increased core strength, paper-to-core bonding, and strength-to-weight ratio. The gypsum board is not reinforced with glass fibers and the acrylic polymer does not create a tacky bond between the glass fiber and the gypsum matrix.

U.S. Pat. No. 6,171,388 to Jobbins discloses a lightweight gypsum composition. The composition comprises (a) gypsum ($CaSO_4.2H_2O$); (b) one or more naturally occurring or synthetic latex polymers including ethylenically unsaturated monomers selected from (meth)acrylic based acids and esters, acrylonitrile, styrene, divinylbenzene, vinyl esters, acrylamide, methacrylamide, vinylidene chloride, butadiene and vinyl chloride and mixtures thereof; and (c) one or more nonionic surfactants; wherein the gypsum composition has a density less than 0.64 g/cm$^3$. The gypsum board is made from a slurry that has low density due to foaming and has no glass fibers incorporated within the gypsum matrix. The bond is therefore between gypsum-hydrated crystals using the latex binder, not between a glass fiber and gypsum matrix. Further the bond is not tacky.

U.S. Pat. No. 6,254,817 to Cooper et al. discloses a composite fabric for use in reinforcing cementitious boards and similar prefabricated building wall panels. The fabric is embedded in the cement matrix and closely adjacent to the surface (e.g. within 1/16") of the panels or boards. The fabric preferably comprises a mesh of continuously coated, high elastic modulus strands, which are preferably bundled glass fibers encapsulated by alkali and water resistant thermoplastic material. The disposition of the fabric near the surface advantageously optimizes reinforcement. Preferred coating materials include polypropylene, polyethylene, copolymers of polybutylene and propylene, ethylene propylene rubber, thermoplastic polyolefin rubber, polyvinylidene chloride, and ethylene-propylene diene monomer. The cement board is not a gypsum board and the glass fiber is coated with the thermoplastic coating prior to insertion in cement board. The coating of these polymeric materials does not result in a tacky bond layer.

U.S. Pat. No. 6,294,253 to Smith, Jr., discloses a sized, staple fiber product useful in the manufacture of gypsum board. The fiber surface is coated with an aqueous chemical size composition containing a high level of surfactant such as a poly (Oxy-1,2-ethanediyl), alpha(2-(bis(2-Aminoethyl) Methyl-ammonio)Ethyl)-omega-Hydroxy-, N,N'-Di(C14-18 and C 16-18 unsaturated) Acyl Derivs., Me Sulfate (Salts) and optionally, a polymer film former such as polyvinyl alcohol and a biocide. The sized fibers may ultimately be incorporated as reinforcements in the gypsum core of a construction board. Preferred fibers are 5-23 μm in diameter and chopped to less than 1.5 inches long. The sizing provides a thin polymeric coating that is not tacky.

U.S. Pat. No. 6,524,679 to Hauber et al. discloses a glass reinforced gypsum board. A multilayer gypsum board having face sheets comprising inorganic fiber, preferably randomly oriented glass fiber, which have been completely impregnated with a gypsum slurry so as to penetrate through the random interstices between the inorganic fibers and to thereby coat the board surfaces with gypsum slurry. The multilayer gypsum board may have a polymeric compound added to unset gypsum, the compound may comprise any of the following: polyacrylamide, polymethylacrylamide, polyvinyidene chloride (PVDC), polyamide, poly (hexamethylene adipamide), polyvinylchloride (PVC), polyethylene, cellulose acetate, polyisobutylene, polycarbonate, polypropylene, polystyrene, polychloroprene, styrene, butadiene, natural rubber, poly (2,6 dimethyl pentene oxide), poly (4-methyl-1-pentene) and polydimethyl siloxane. The multilayer gypsum board may comprise a first layer of a mixture of set gypsum having an outer surface and the polymeric compound additive entrained within the set gypsum and being impregnated in a thin sheet of randomly aligned inorganic fibers so as to essentially encase the core gypsum within two facing layers having a combination set gypsum and polymeric compound. A multilayer gypsum board is formed by incorporating glass fibers together with polymeric additives to bury the fibers within the top and bottom surfaces of the board. The edges may be reinforces and continued on to a portion of the top surface as shown in the figure. The inorganic glass fibers are individually incorporated on top and bottom of the cast gypsum but not within the cast gypsum board and the gypsum slurry enriched with polymers. The glass fibers and the polymer is not present within the entire gypsum matrix and does not form a tacky gypsum matrix fiber interface.

U.S. Pat. No. 6,525,116 to Sethuraman et al. discloses a gypsum composition with ionic styrene butadiene latex additive. The gypsum composition comprises functionalized styrene butadiene latex polymers crosslinked by a dimethacrylate having from 2 to 30 ethoxy units between methacrylate functionalities prepared by aqueous emulsion polymerization of a monomeric mixture comprising styrene and butadiene in the presence of a seed polymer. The functionalized styrene butadiene latex is added to gypsum slurry. There are no glass fibers incorporated in the gypsum slurry and the latex bond is provided between gypsum crystals in the form of uniform dispersion. The functionalized latex formed is crosslinked and is therefore not tacky.

U.S. Pat. No. 6,755,907 to Westerman et al. discloses a gypsum composition with styrene butadiene latex additive. Gypsum wallboard made lighter and less dense, without sacrificing strength, by adding to the gypsum slurry used in making the board a styrene butadiene polymer latex substantially stable against divalent ions in which the styrene butadiene polymer latex substantially stable against divalent ions in which the styrene butadiene polymer includes at least 0.25 wt. % of an ionic monomer. The latex polymer is added to gypsum slurry, which does not have glass fibers. The latex polymer does not form a tacky bond layer on glass fibers.

U.S. Patent Application U.S. 2003/0134079 to Bush et al. discloses a method and composition for coating mat and articles produced therewith. The coated glass mat comprises a glass mat substrate having non-woven glass fibers and a coating, which essentially uniformly penetrates the glass mat substrate to desired fractional thickness of the coated glass mat. Coating is preferably a coating blend comprised of water, latex binder, inorganic pigment, and inorganic binder. The coating imparts a tensile strength to the coated glass mat, which on average is at least 1.33 times greater than the tensile strength of the glass mat substrate without the coating. Moreover, a non-coated thickness of the coated glass mat is sufficiently thick for bonding purposes with, for example, a gypsum slurry or other core materials such as thermoplastic or thermosetting plastics. The coating has porosity, which provides the coated glass mat with a porosity sufficient to allow water vapor to escape from a gypsum slurry when heated. A glass mat with non-woven glass fibers is coated with water, latex binder, inorganic pigment, and inorganic binder using a larger wrap kiss coater. The binder penetrates 25% to 75% of the thickness of the mat, leaving a rough uncoated free surface. The mat may be placed on gypsum slurry, thereby reinforcing the gypsum board. The non-woven glass mat is bonded with water, latex binder, inorganic pigment, and inorganic binder and the binder is not water soluble or reversible. The glass fiber mat is placed on top of gypsum slurry forming the gypsum board and not incorporated within the gypsum board. The bond between the fiber and the gypsum matrix is not tacky.

U.S. Patent Application 2004/0082240 to Rodrigues (hereinafter the '240 patent application) is directed to a fiberglass nonwoven binder. It employs aqueous solution of a copolymer binder having a monomer or acid functionality and a monomer of hydroxyl or amine functionality applied to hot nonwoven fiberglass fibers and heat cured to form a fiberglass mat that is strongly bound, yet flexible. The '240 patent application discloses a number of acid functionality monomers and hydroxyl or amine functionality monomers. Specifically, it discloses acrylic acid [para 0011] a carboxylic acid monomer and triethanol amine, an amine functionality monomer that crosslinks without the need for external crosslinking agents [para 0020]. The monomer mixture polymerizes or crosslinks when it contacts the hot fiber surface, creating a bond at the contact points. This is strictly creation of bond between two fiberglass fibers, not between a glass fiber and gypsum matrix. The polymer is created during cure by crosslinking and does not pre-exist in the solution forming a tacky coating on glass fibers.

U.S. Patent Application 2004/0082241 to Rodrigues (hereinafter the '241 patent application) is directed to a Fiberglass nonwoven binder. It is a continuation in part of U.S. Patent Application 2004/0082240 (discussed herein above). The '241 patent application also relates to the use of polyamines as crosslinkers for a polymer binder. It employs an aqueous solution of a copolymer binder having a monomer or acid functionality and a monomer of hydroxyl or amine functionality applied to hot nonwoven fiberglass fibers and heat cured to form a fiberglass mat that is strongly bound, yet flexible. The '241 patent application discloses a number of acid functionality monomers and hydroxyl or amine functionality monomers and polyamine crosslinking agents. Specifically, the patent discloses acrylic acid [para 0013] a carboxylic acid monomer and triethanol amine, an amine functionality monomer that crosslinks without the need for external crosslinking agents [para 0023]. The monomer mixture polymerizes, or crosslinks, when it contacts the hot fiber surface creating a bond at the contact points. This is strictly creation of bond between two fiberglass fibers, not between a glass fiber and gypsum matrix. The polymer is created during cure by crosslinking and does not pre-exist in the solution forming a tacky coating on glass fibers.

Notwithstanding the advances in the field of gypsum boards and related articles, there remains a need in the art for a readily and inexpensively produced gypsum board having improved strength and flexure resistance with superior nail pull out resistance.

SUMMARY OF THE INVENTION

The present invention provides an improved gypsum board having high strength, improved flexure resistance and improved nail pull out resistance. The improved gypsum board has glass fiber reinforcement that is bonded to the gypsum matrix through the incorporation of a tacky adhesive on the surface of glass fibers. The tacky adhesive, having a thickness of 0.25 to 2 microns, is applied over the surface of the glass fibers by precipitating a water-soluble copolymer, comprised of methacrylic acid and dimethyldiallyammonium chloride, from a solution that is made neutral or alkaline or by evaporation of an acidic polymer solution. As the gypsum composition hydrates, forming gypsum crystals that are acicular and interlocking, a tacky bond is established between the tacky evaporated or precipitated coating on the glass fibers and the gypsum crystals adjacent to the glass fiber. When the gypsum board contains glass fibers bonded with tacky sizing, the board can be stressed without debonding of the fibers due to the compliant nature of the tacky bond layer, thereby providing a gypsum board with improved flexure strength and nail pullout resistance.

The molecular weight of water-soluble polymer, which provides the tacky bond functionality, is critical to adhesion between gypsum crystal and fiber glass surface. If the molecular weight is low, the tacky adhesive has excessive flow resulting in poor bonding properties. If the molecular weight is extremely high, the tackiness of the bond layer is lost. Therefore it is important to have the correct molecular weight of the polymer. It is generally desired to have a molecular weight of 3,000 to 20,000. The polymer dissolves in an acidic water solution and precipitates out when the solution is made to neutral or alkaline.

The polymer may be applied to the surface of the glass fiber by roller coating as the glass fiber forms or immersing chopped fibers in an acidulated solution of the polymer and evaporating the solution or precipitating the polymer by adding alkali to the solution to effect precipitation of the polymer. The glass fibers may be filtered to separate the evaporated or precipitated polymeric coating and may be added to a pre-mixed gypsum slurry. In an alternate arrangement, the gypsum hemihydrate may be added to the neutralized or alkalized solution to form the gypsum slurry. The quantity of polymer applied by evaporation or precipitation is selected to be in the range of 0.01 to 3 weight percent of the glass fiber weight and this provides a tacky layer coating thickness of 0.25 to 2 microns. During the gypsum cure cycle, the excess water is evaporated and the tacky polymer coated glass fiber comes into intimate contact with acicular gypsum crystals forming a compliant bond. When the board is flexed or subjected to stress during nail pullout, the glass fiber—gypsum matrix interface is stressed. Instead of the glass fiber separating from the gypsum matrix, the structure is retained by the compliant nature of the tacky bond between the gypsum matrix and the glass fiber external surface. The tacky bond also provides energy absorption and the board absorbs significant energy prior to breakage, thereby providing increased flexure strength.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention provides a gypsum board having glass fibers coated with a tacky sizing. Individual glass fiber bundles are coated with a copolymer solution, composed of methacrylic acid and dimethyldiallyammonium chloride having a concentration of 1 to 10 weight percent. This polymer is available from Alco under the trade name Exp. 3819. The polymer is fully reacted with a molecular weight of 3,000 to 20,000 and is readily soluble in acidulated water to form a solution. This polymer solution may be coated on glass fibers by roller coating to form a tacky polymeric coating on glass fibers. In an alternate embodiment, alkali is added to neutralize or alkalize the solution, thereby precipitating the polymer out of the solution and delivering the polymer over the external surface of the glass fibers. At this stage, an agitator may be used in the vessel to deliver the precipitates to uniformly coat the surfaces of the glass fibers. The liquid may be filtered to separate the coated glass fibers, which may be inserted into a gypsum slurry mix comprising calcium sulfate hemihydrate together with usual additives such as surfactants, foam formers, biocides and the like. In this case, the polymeric coating is applied as a sizing for the glass fibers promoting the bond between the glass fibers and the gypsum matrix. On the other hand, the calcium sulfate hemihydrate and other additives may be added to the alkaline solution to form the gypsum slurry with coated glass fiber reinforcement. In either case, the slurry may be cast on a Kraft face paper surface, and a second Kraft back paper may be applied forming a gypsum board. The continuous gypsum board is cut to size and dried and cured in a heated furnace. During the drying and curing cycle excess water evaporates bringing the coated glass fibers in contact with hydrated acicular gypsum crystals creating a tacky bond between the gypsum matrix and the glass fiber. The tacky bond interface transfers load to the glass fiber compliantly and as a result the gypsum matrix does not break easily.

Figure 1:
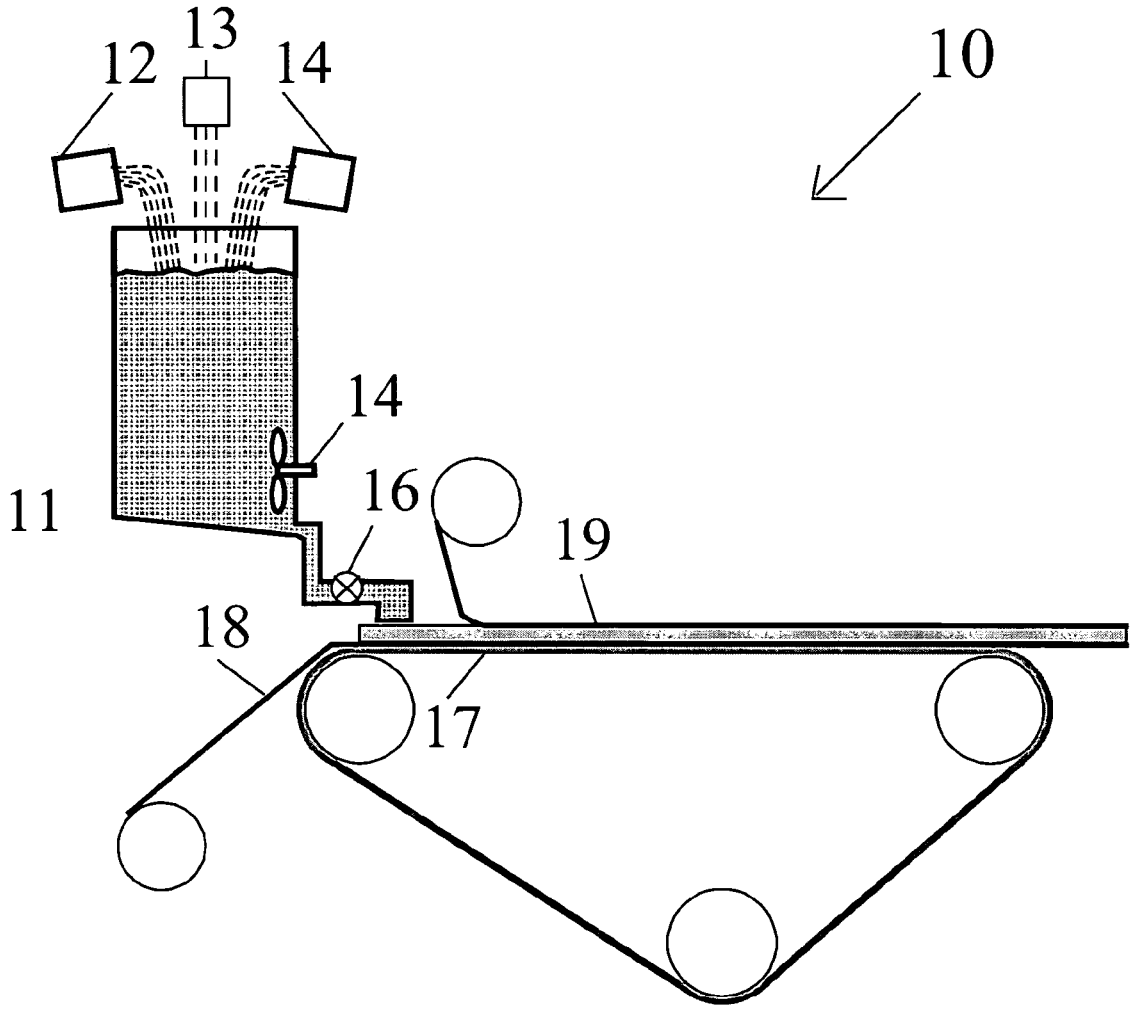
FIG. 1 is a schematic diagram of a manufacturing process for gypsum boards incorporating a tacky coating on glass fiber external surfaces.

Referring now to FIG. 1, there is shown at 10 one embodiment of the subject invention wherein the polymeric solution is alkalized to precipitate the tacky polymer over the external surface of the glass fiber. The vessel 11 contains acidulated water with a polymeric composition, which dissolves readily in the water. Chopped fiber 12 is added to the acidulated polymeric solution. Next, alkali 13 is added to the acidulated polymeric solution; first to neutralize the acid and then to alkalize the solution so that the polymer precipitates out of solution and onto the external surface of the glass fiber. Calcium sulfate hemihydrate and other additives are then added to the vessel 11 at 14. Agitator 15 stirs the mixture to form gypsum slurry of desired consistency that is cast through a closure valve 16 on a moving belt 17 that carries a Kraft paper facer 18. A second layer of Kraft paper facer 19 is placed on the cast gypsum board and the continuous gypsum board is scored to size and dried and cured in oven.

Figure 2:
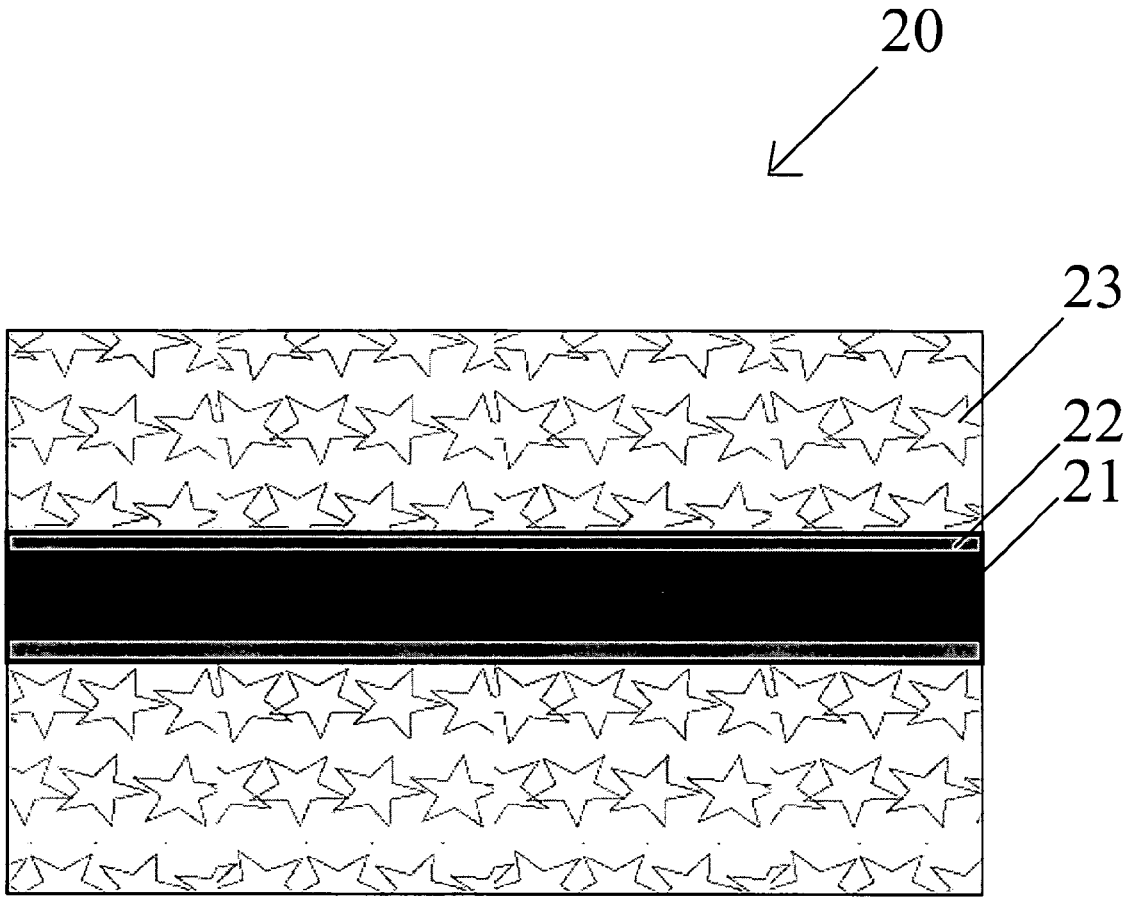
FIG. 2 is a cross-sectional view of a gypsum board illustrating a single glass fiber coated with a tacky bond layer that bonds with the gypsum matrix.

Referring now to FIG. 2 there is shown at 20 a schematic microstructure of the gypsum board having glass reinforcement coated with tacky bond layer. The glass fiber 21 has a tacky layer polymeric coating 22, which is in contact with gypsum crystals 23 that are acicular. A number of glass fibers are oriented in nearly random or predetermined geometrical arrangement to provide reinforcement properties.

The mechanical properties of gypsum boards manufactured with and without tacky bond coating are measured. The flexure test and nail pullout test results were obtained from unfaced normalized to density gypsum handboard in stead of faced gypsum board as described in the ASTM method. The test results are shown below.

| Process | Stucco Only | Standard Deviation | Product Without Tacky Coating | Standard Deviation | Product With Tacky Bond Coating | Standard Deviation |
|---|---|---|---|---|---|---|
| Flexure Strength kN | 0.096 | 0.0090 | 0.097 | 0.005 | 0.097 | 0.006 |
| Nail Pull Strength kN | 0.180 | 0.022 | 0.275 | 0.015 | 0.287 | 0.021 |

The nail pullout resistance of stucco alone, without glass fibers, is very low. Adding glass fibers improves nail pullout due to the snagging effect of the glass fibers. This does not mean that the gypsum does not break in the form of chunks since the gypsum matrix does not transfer the load to the glass fibers. On the other hand, when glass fibers are coated with a tacky bond coating according to the subject invention, the nail pullout resistance is markedly improved. In addition, the gypsum matrix does not break in the form of chunks when the nail is pulled out due to the load transferring capability of the tacky bond layer.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A gypsum board, comprising:

a. a gypsum matrix formed from an aqueous alkaline gypsum slurry and having a bottom and a top, said gypsum matrix being operable to form gypsum crystals when said gypsum board is cured;

b. a first facer sheet placed on said bottom of said gypsum matrix;

c. a second facer sheet placed on said top of said gypsum matrix;

d. one or more glass fibers placed within said gypsum matrix;

e. said glass fibers having a tacky polymeric coating formed by roller coating or evaporation of acidulated aqueous polymer solution, or by precipitation from an aqueous alkaline gypsum slurry comprising a polymer composition, said tacky coating comprising an acidulated water-soluble copolymer comprised of methacrylic acid and dimethyldiallyammonium chloride; and f. said polymer composition materializing as a tacky coating evaporated or precipitated on said glass fibers, forming a compliant bond with said gypsum crystals during said curing of said gypsum board, said tacky coating providing increased strength, flexure resistance and nail pull out resistance to said gypsum board.

2. A gypsum board as recited by claim 1, wherein each of said first and said second facer sheets comprises Kraft paper.

3. A gypsum board as recited by claim 1, wherein said gypsum matrix comprises calcium sulphate hemihydrate ($CaSO_4 \cdot \frac{1}{2}H_2O$), calcium sulphate anhydrite ($CaSO_4$), hydraulic setting cement and water.

4. A gypsum board as recited by claim 3, wherein said hydraulic setting cement is selected from the group consisting of Portland cements, sulphate resisting cements, blast furnace cements, pozzolanic cements, and high alumina cements.

5. A gypsum board as recited by claim 1, wherein said tacky coating applied by evaporation or precipitation has a thickness ranging from about 0.25 to 2 microns.

6. A gypsum board as recited by claim 1, wherein said tacky coating comprises an acidulated water soluble copolymer comprised of methacrylic acid and dimethyldiallyammonium chloride and having a molecular weight of 3,000 to 20,000.

7. A gypsum board as recited by claim 1, wherein said tacky polymer composition is applied by roller coating of said acidulated aqueous polymer solution having 1 to 10 weight percent polymer.

8. A gypsum board as recited by claim 1, wherein said polymer composition in said aqueous alkaline gypsum slurry is 0.02 to 3 weight percent of said glass fibers incorporated within said gypsum matrix.

9. A gypsum board as recited by claim 1, wherein said glass fibers are randomly arranged.

10. A gypsum board as recited by claim 1, wherein said glass fibers are arranged in the form of an organized structure.

11. A method of coating glass fibers with a tacky polymeric composition, comprising:

a. dissolving a copolymer comprised of methacrylic acid and dimethyldiallyammonium chloride in a solution, said solution being acidic;

b. applying tacky polymer coating by roller coating of said solution;

c. evaporating said solution to form a tacky polymeric composition on said glass fibers.

12. A method of coating glass fibers with a tacky polymeric composition, comprising:

a. dissolving a copolymer comprised of methacrylic acid and dimethyldiallyammonium chloride in a solution, said solution being acidic;

b. immersing glass fibers within said solution;

c. neutralizing said acidity of said solution by adding an alkaline composition to said solution;

d. further adding said alkaline composition to said solution to render said solution alkaline and thereby initiating precipitation of said tacky polymeric composition; and e. agitating said solution to promote uniform coating of said glass fibers with said tacky polymeric composition.

13. A process for manufacture of gypsum board, comprising the steps of:

a. incorporating glass fibers having a tacky coating within a gypsum slurry to form a gypsum mixture, said tacky coating comprising an acidulated water-soluble copolymer comprised of methacrylic acid and dimethyldiallyammonium chloride and said gypsum mixture having a top and a bottom;

b. casting said gypsum mixture on a first facer sheet;

c. applying a second facer sheet placed on said top of said gypsum mixture forming a gypsum board; and d. drying and curing said gypsum board, said gypsum board being operative to increase strength, flexure resistance and nail pull out resistance.

14. A process for manufacture of gypsum board, comprising the steps of:

a. dissolving a copolymer comprised of methacrylic acid and dimethyldiallyammonium chloride in acidified water to form a solution;

b. incorporating glass fibers within said solution, said glass fibers having external surfaces;

c. adding alkali to said solution to render an alkaline solution and precipitate said copolymer on said external surfaces;

d. agitating said alkaline solution with said copolymer precipitates to provide a uniform tacky coating on said external surfaces;

e. adding calcium sulfate hemihydrate with surfactants, foaming agents, biocides and additives to said alkaline solution to form a gypsum slurry of castable consistency;

f. casting said gypsum slurry with said glass fibers having said uniform tacky coating onto a first facer sheet, said gypsum slurry having a top and a bottom;

g. applying a second facer sheet to said top of said gypsum slurry forming a gypsum board; and h. drying and curing said gypsum board, said gypsum board being operative to increase strength, flexure resistance and nail pull out resistance.

* * * * *